US011452320B2

(12) United States Patent
Buffalini

(10) Patent No.: US 11,452,320 B2
(45) Date of Patent: Sep. 27, 2022

(54) OVER-THE-HEAD DISPOSABLE CONTACT ISOLATION GOWN AND METHOD FOR MAKING THE SAME

(71) Applicant: ASCENSION HEALTH ALLIANCE, St. Louis, MO (US)

(72) Inventor: Maria Louise Buffalini, Beech Grove, TN (US)

(73) Assignee: Ascension Health Alliance, St. Louis, MO (US)

( * ) Notice: Subject to any disclaimer, the term of this patent is extended or adjusted under 35 U.S.C. 154(b) by 37 days.

(21) Appl. No.: 16/368,240

(22) Filed: Mar. 28, 2019

(65) Prior Publication Data

US 2019/0297967 A1 Oct. 3, 2019

Related U.S. Application Data

(60) Provisional application No. 62/649,643, filed on Mar. 29, 2018.

(51) Int. Cl.
*A41D 13/12* (2006.01)
*A62B 17/00* (2006.01)

(52) U.S. Cl.
CPC ..... *A41D 13/1209* (2013.01); *A41D 13/129* (2013.01); *A41D 13/1245* (2013.01); *A41D 2400/52* (2013.01); *A62B 17/006* (2013.01)

(58) Field of Classification Search
CPC ..... A41D 13/1209; A41D 13/129; A41D 13/1245; A41D 2400/52; A41D 13/12; A41D 13/1236; A41D 3/005; A41D 1/04; A41D 2400/44; A41D 27/16; A62B 17/006
USPC ..... 2/46
See application file for complete search history.

(56) References Cited

U.S. PATENT DOCUMENTS 2,692,989 A * 11/1954 Jelstrup ..... A41D 13/1236 2/114
3,451,062 A * 6/1969 Bradley ..... A41D 13/1236 2/114
4,737,995 A * 4/1988 Wiley ..... A41D 13/129 2/114

(Continued)

FOREIGN PATENT DOCUMENTS

EP 1147718 A2 10/2001

OTHER PUBLICATIONS

PCT International Search Report and Written Opinion, Application No. PCT/US2019/024629, dated Jul. 9, 2019, 14 pps.

*Primary Examiner* — Khoa D Huynh
*Assistant Examiner* — Uyen T Nguyen
(74) *Attorney, Agent, or Firm* — Armstrong Teasdale LLP

(57) ABSTRACT

A disposable contact isolation gown for protection from hospital-acquired infections is provided. The contact isolation gown includes a front panel including a front collar edge, a pair of front shoulder edges, a pair of front side edges, and a front bottom edge. The gown also includes a back panel coupled to the front panel at a pair of side seams. The back panel includes a back collar edge, a back line of weakness extending from the back collar edge to the back bottom edge, and a pair of back panel portions coupled together at the back line of weakness. The gown also includes a pair of arm panels coupled between the front panel and the back panel. Each arm panel includes an arm panel back edge, an arm panel front edge, and an arm panel collar edge.

17 Claims, 5 Drawing Sheets

(56) References Cited

U.S. PATENT DOCUMENTS 4,951,318 A 8/1990 Harreld et al.
5,093,934 A * 3/1992 Dillon, Jr. ..... A41D 13/1209 2/105
5,414,867 A * 5/1995 Bowling ..... A41D 13/1209 2/46
5,444,872 A 8/1995 Johnson
5,586,339 A * 12/1996 Lathan ..... B29C 65/02 2/46
5,652,961 A 8/1997 Knight-Yurt
6,138,278 A * 10/2000 Taylor ..... A41D 13/1227 2/114
7,748,054 B2 * 7/2010 Araquistain ..... A41D 13/04 2/50
7,971,274 B2 7/2011 Graneto, III
8,707,464 B2 4/2014 Trenhaile
2001/0032346 A1 * 10/2001 Matsushita ..... A41D 13/1209 2/83
2002/0095711 A1 * 7/2002 Saito ..... A41D 13/1209 2/71
2004/0098782 A1 * 5/2004 Griesbach, III ..... A41F 17/00 2/51
2006/0277654 A1 * 12/2006 Turner ..... A41D 13/1236 2/114
2007/0028343 A1 2/2007 Makowka
2008/0155728 A1 7/2008 Hafer et al.
2010/0017933 A1 1/2010 Taylor-Barry
2010/0212063 A1 * 8/2010 Baucom ..... A41D 13/1254 2/114
2010/0299805 A1 * 12/2010 Graneto, III ..... A41D 13/1209 2/114
2013/0091615 A1 4/2013 Pasko et al.
2013/0276204 A1 * 10/2013 Pasko ..... A41D 13/12 2/114
2013/0318682 A1 * 12/2013 Graneto, III ..... A41D 13/1209 2/114
2014/0189931 A1 * 7/2014 Fredrickson ..... A41D 27/205 2/114
2015/0135398 A1 * 5/2015 Czajka ..... A41D 13/12 2/114
2016/0088886 A1 * 3/2016 Kirwan ..... A41D 13/1254 2/114
2016/0220852 A1 * 8/2016 Samaniego ..... A41D 27/00
2016/0345645 A1 12/2016 Reese et al.
2018/0000174 A1 * 1/2018 Benson ..... A41D 13/12
2019/0289932 A1 * 9/2019 Schultz ..... A41D 13/1245

* cited by examiner

OVER-THE-HEAD DISPOSABLE CONTACT ISOLATION GOWN AND METHOD FOR MAKING THE SAME

CROSS-REFERENCE TO RELATED APPLICATIONS

This application claims the benefit of priority to U.S. Provisional Patent Application No. 62/649,643, filed Mar. 29, 2018, entitled "OVER-THE-HEAD DISPOSABLE CONTACT ISOLATION GOWN AND METHOD FOR MAKING THE SAME," the entire contents and disclosure of which are hereby incorporated by reference herein in their entirety.

BACKGROUND

This disclosure relates generally to infection control products, and more specifically, to a disposable contact isolation gown that is generally utilized by healthcare workers and visitors to certain hospital units.

Utilizing disposable isolation contact gowns (also referred to as contact precautions gowns) is standard practice among healthcare workers when interacting with patients placed under isolation precautions. Isolation contact gowns are meant to protect healthcare workers from hospital-acquired infections (e.g., *Clostridium difficile*) when interacting with patients. For an isolation contact gown to be an effective barrier against sources of infectious agents (e.g., blood, bodily fluids, secretions), the gown needs to fully cover a wearer's body. For example, when a gown is left untied, and a portion of the wearer's clothing or skin is exposed, there is a chance that bacteria or viruses may come in contact with the wearer as the wearer engages in patient-care activities. The wearer subsequently risks exposing other people to infection as the wearer comes in contact with other healthcare workers and patients.

Gowns that fully surround the body are the norm for certain patients, due to prior clothing removal. However, with a heightened awareness regarding infection prevention and control in the healthcare setting, there is a corresponding need for healthcare workers, and any visitors to certain units within a medical facility, to be completely covered when interacting with patients. A full coverage gown that can easily be put on by a user, and easily taken off by the user is more likely to be worn properly by a user, and protect the user against infection and contamination. As such, there is still an unfilled need for a full coverage gown that requires minimal effort to wear properly and remove efficiently.

BRIEF DESCRIPTION

In one embodiment, a disposable contact isolation gown for protection from hospital-acquired infections is provided. The contact isolation gown includes a front panel including a front collar edge, a pair of front shoulder edges, a pair of front side edges, and a front bottom edge. The gown also includes a back panel coupled to the front panel at a pair of side seams. The back panel includes a back collar edge, a back line of weakness extending from the back collar edge to the back bottom edge, and a pair of back panel portions coupled together at the back line of weakness. The gown also includes a pair of arm panels coupled between the front panel and the back panel. Each arm panel includes an arm panel back edge, an arm panel front edge, and an arm panel collar edge.

In another embodiment, a disposable contact isolation gown is provided that includes a front panel, a back panel, and a pair of arm panels. The isolation contact gown includes a front panel that has a front collar edge, a pair of front shoulder edges, a pair of front side edges, and a front bottom edge. The isolation contact gown also includes a back panel coupled to the front panel at a pair of side seams. The back panel includes a back collar edge, a pair of back shoulder edges extending from the back collar edge, a back line of weakness extending from the back collar edge, a pair of back side edges, and a back bottom edge. The isolation contact gown also includes a pair of arm panels coupled between the front panel and the back panel. Each arm panel includes an arm panel back edge, an arm panel front edge, an arm panel collar edge, a sleeve back edge, a sleeve front edge, and a cuff edge. The arm panel back edge of each arm panel is coupled to one of the back shoulder edges at a shoulder line of weakness.

In yet another embodiment, a method of manufacturing a disposable contact isolation gown is provided. The method includes providing a front panel comprising a front collar edge, a pair of front shoulder edges, a pair of front side edges, and a front bottom edge. The method also includes providing a back panel coupled to the front panel at a pair of side seams. The back panel includes a back collar edge, a back line of weakness extending from the back collar edge to the back bottom edge, and a pair of back panel portions coupled together at the back line of weakness. The method also includes providing a pair of arm panels coupled between the front panel and the back panel. Each arm panel includes an arm panel back edge, an arm panel front edge, and an arm panel collar edge.

DETAILED DESCRIPTION

Figure 1:
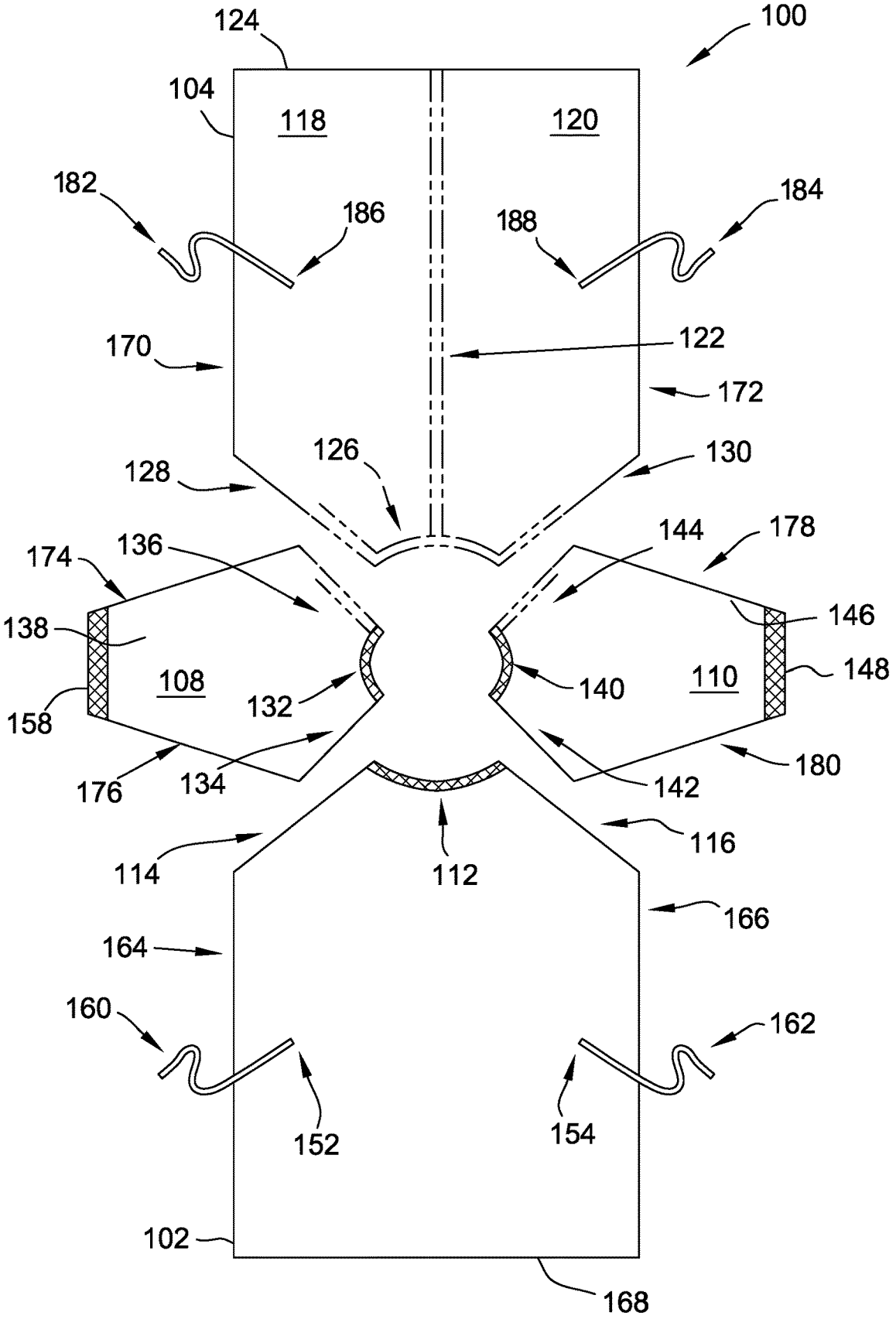
FIG. 1 is an exploded view of an example embodiment of an isolation contact gown.

The following detailed description illustrates the disclosure by way of example and not by way of limitation. The description enables one skilled in the art to make and use the disclosure, describes several embodiments, adaptations, variations, alternatives, and uses of the disclosure, including what is presently believed to be the best mode of carrying out the disclosure.

Embodiments of the present disclosure provide a disposable contact isolation gown including a front panel, a back panel, and a pair of arm panels coupled between the front panel and the back panel. Embodiments include a back panel coupled to a pair of arm panels at a shoulder line of weakness of a front collar edge. Embodiments also include a back line of weakness extending from the back collar edge. Some embodiments include a front collar edge that is un-removably attached to the arm panel collar edges of the arm panel. Embodiments of the present disclosure also include a back collar edge that is detachably coupled to the arm panel collar edges of the arm panels. The back collar edge includes a line of weakness that extends the length of back collar edge. The front collar edge, arm panel collar edges, and the back collar edge form a head opening. The head opening enables a wearer to easily wear the gown by inserting their head through the head opening. Embodiments of the present disclosure also include fully formed sleeves for the wearer to insert their respective arms through. When properly worn, the shoulders, arms, torso and a portion of the wearer's legs are covered and protected by the gown.

Embodiments also include the back line of weakness extending from the back collar edge to a back bottom edge. Some embodiments include a pair of back panel portions coupled together at a back line of weakness. Additionally, embodiments of the present disclosure include a pair of back shoulder edges extending from the back collar edge. Each back shoulder edge forms a portion of a shoulder line of weakness. The shoulder lines of weakness, the back line of weakness, and the lines of weakness proximate the back collar edge, are all useful in enabling a wearer to remove the gown. When a wearer wants to remove the gown, the wearer grabs a portion of the front panel and pulls the front panel away from their body. The lines of weakness described above will cause breakages, allowing for a relatively easy removal of the gown. The lines of weakness may be manufactured to vary in strength to enable different areas of the gown to tear first (e.g., back shoulder edges, back collar edge, back panel). In other embodiments, the lines of weakness may be manufactured to be substantially equal in strength to enable the shoulder lines of weakness, the back line of weakness, and the lines of weakness proximate the back collar edge to tear at the same time.

As used herein, "line of weakness" refers to perforations (e.g., serrations), and is illustrated in the figures as dash-dot lines. Lines of weakness allow for quick and easy removal of the gown when the wearer pulls on a portion of the front panel, such as the front collar edge. As mentioned above, lines of weakness are shown in the figures as dash-dot lines in the material from which the gown is fabricated. In alternative embodiments, lines of weakness can take the form of individual ovals or other geometric figures that have been cut out of the material, simplifying removal of the gown from the wearer.

Embodiments of the present disclosure include tie members to enable the wearer to secure the gown around the wearer's body. A pair of tie members can be affixed to the front panel and/or the back panel. Tie members can be provided on opposing sides of the front panel and/or the back panel. The wearer can couple the front panel tie members with the back panel tie members at corresponding sides of the wearer's body. The tie members allow the wearer to adjust the size and shape of the gown so the gown can fully and securely cover the wearer.

In some embodiments, the tie members on the front and/or back panels can be encased or covered in a plastic film. The plastic film includes a pull tab feature that enables the wearer to peel the plastic film to access the tie member. The plastic film helps to keep the tie members secure to the gown to avoid the tie members from being snagged when not being used with the gown. In these embodiments, the wearer is provided with the option of having tie members if the wearer needs a more secure fit. In certain embodiments, the tie members may be of flexible retractable material that allow the tie members to stretch and return to their respective side edge positions. For example, in these embodiments, the tie members may be spring-loaded (e.g., spring-based) and/or coil-shaped tie members that stretch in an accordion-like manner and retract to a compact configuration to avoid being snagged or caught on something, such as a medical equipment, when not tied. In further embodiments, the disposable contact isolation gown may not include tie members. In these embodiments, elastic gatherings may be provided on the front panel and/or the back panel so the gown can securely fit the wearer without a tie member. In these embodiments, elastic may be provided part of the gown material, and may enable the front panel and/or the back panel to stretch and contract based upon the size of the wearer to ensure a snug fit for the wearer.

Embodiments of the disposable contact isolation gown may be fabricated using nonwoven fabric. Nonwoven fiber-bonding technologies (e.g., thermal, chemical, or mechanical) may be used to produce embodiments of the gown. Additionally, the gown may be fabricated from suitable forms of synthetic fibers (e.g., polypropylene, polyester, polyethylene). One embodiment of the gown is fabricated using polypropylene that has been coated with a polyethylene coating. Another embodiment utilizes spunbond melt-blown spunbond (SMS) materials in the fabrication of the gown. Another embodiment of the gown is fabricated using low-density polyethelene (LDPE).

Upon completion of manufacturing, the disposable contact isolation gown is folded and placed into a fold-over, self-contained pouch which is sized to be compatible with at least one known personal protection equipment organizer. In embodiments where the disposable contact isolation gown does not include tie members, a belt can separately be provided in the self-contained pouch. In these embodiments, the belt may be used to provide wearers, such as those with small frames, a more secure fit. The gown may be manufactured in a single size (e.g., one size). In an alternative embodiment, the gown may be manufactured in a variety of sizes (e.g., small, medium, large, x-large, xx-large).

Referring now to the drawings, FIG. 1 is an exploded view of an example embodiment of a disposable contact isolation gown 100. As explained below in more detail, gown 100 includes a front panel 102, a back panel 104, and a pair of arm panels, such as a first arm panel 108 and a second arm panel 110. Front panel 102 includes front collar edge 112 between a pair of front shoulder edges, such as first front shoulder edge 114 and a second front shoulder edge 116. First front shoulder edge 114 and second front shoulder edge 116 extend obliquely from front collar edge 112. Front panel 102 also includes a pair of front side edges, such as first front side edge 164 and second front side edge 166. In the example embodiment, first front side edge 164 is attached to first front shoulder edge 114, and second front side edge 166 is attached to second front shoulder edge 116. Front panel 102 includes a front bottom edge 168 that extends between first front side edge 164 and second front side edge 166.

Back panel 104 includes a back line of weakness 122 that extends from a back collar edge 126. In the example embodiment, back line of weakness 122 includes a plurality of lines of weakness oriented parallel relative to each other. Back line of weakness 122 extends from a back collar edge 126 to a back bottom edge 124. In the example embodiment, back panel 104 also includes a pair of back panel portions, such as a first back panel portion 118 and a second back panel portion 120, which are coupled together at back line of weakness 122. Back line of weakness 122 may be substantially equal to a length of the pair of back panel portions (first back panel portion 118 and second back panel portion 120).

Back collar edge 126 also includes a line of weakness along the length of back collar edge 126. In the example embodiment, the line of weakness extends along the entire length of back collar edge 126. In some embodiments, a line of weakness extends along a partial length of back collar edge 126. In other embodiments, back collar edge 126 includes a plurality of lines of weakness. Back collar edge 126 is between a pair of back shoulder edges, such as first back shoulder edge 128 and a second back shoulder edge 130. Back panel 104 also includes a pair of back side edges, such as first back side edge 170 and second back side edge 172. First back side edge 170 is attached to first back shoulder edge 128, and second back side edge 172 is attached to second back shoulder edge 130. First back shoulder edge 128 and second back shoulder edge 130 extend obliquely from back collar edge 126. Each back shoulder edge 128 and 130 forms a portion of a shoulder line of weakness, as shown by dash-dot lines along back shoulder edges 128 and 130. Other configurations for lines of weakness are considered, as long as they provide the utility of tearing the material of gown 100 in the location of the line of weakness when the wearer pulls a portion of front panel 102 away from their body.

First arm panel 108 and second arm panel 110 are positioned between front panel 102 and back panel 104. First arm panel 108 includes a first arm panel collar edge 132 between a first arm panel front edge 134 and a first arm panel back edge 136. First arm panel 108 also includes a first sleeve back edge 174 attached to first arm panel back edge 136, and a first sleeve front edge 176 attached to first arm panel front edge 134. First arm panel back edge 136 forms a portion of a shoulder line of weakness, as shown by dash-dot lines along first arm panel back edge 136. A first sleeve 138 extends between first arm panel collar edge 132 and a first cuff edge 158. Second arm panel 110 includes a second arm panel collar edge 140 between a second arm panel front edge 142 and a second arm panel back edge 144. Second arm panel 110 also includes a second sleeve back edge 178 attached to second arm panel back edge 144, and a second sleeve front edge 180 attached to second arm panel front edge 142. Second arm panel back edge 144 forms a portion of a shoulder line of weakness, as shown by dash-dot lines along second arm panel back edge 144.

A second sleeve 146 extends between second arm panel collar edge 140 and a second cuff edge 148. In the example embodiment, first cuff edge 158 and second cuff edge 148 include elastic gatherings to provide a secure fit. The elastic gatherings may be one or more elastic bands, strips, or fold-over elastic material. When properly utilized, the elastic gatherings of first cuff edge 158 and second cuff edge 148 provide a gathering function for excess sleeve material, which is beneficial to wearers of different sizes. Further, the elastic gatherings of first cuff edge 158 and second cuff edge 148 prevent the sleeves, first sleeve 138 and second sleeve 146, from creeping up the arm or getting in the way of the wearer during use of gown 100. Similarly, front collar edge 112, first arm panel collar edge 132, and second arm panel collar edge 140 also include elastic gatherings (e.g., elastic/rubber bands) to provide a secure fit around the wearer's neck. The elastic gatherings of the sleeves (first sleeve 138 and second sleeve 146) and the collar edges (front collar edge 112, first arm panel collar edge 132, and second arm panel collar edge 140) allow for the arm sleeves and collar to expand and contract to accommodate different body sizes (e.g., differences in arm and neck circumferences). Such features not only operate to make gown 100 more pleasant to wear, but help reduce the spread of germs, viruses, bodily fluids, and the like.

Gown 100 includes tie members 160, 162, 182, and 184 to allow for size adjustments. In the example embodiment, front panel 102 includes first front tie member 160 proximate first front side edge 164, and a second front tie member 162 proximate second front side edge 166. Back panel 104 includes a first back tie member 182 proximate first back side edge 170, and a second back tie member 184 proximate second back side edge 172. In the example embodiment, the wearer ties first front tie member 160 and first back tie member 182 together, and second front tie member 162 and second back tie member 184 together.

In the example embodiment, tie members are positioned at opposing side edges of front panel 102 and back panel 104. Tie members may be attached to front panel 102 and back panel 104 by utilizing any suitable fastening means that do not cut into gown 100, as cuts (e.g., slits, holes, openings) in gown 100 may expose the wearer's skin and/or clothes to contaminants. Suitable fastening means may include stitches, adhesives, and/or other sealing processes such as a heat seal.

In one embodiment, ends 152 and 154 of first front tie member 160 and second front tie member 162 may be sewn to front panel 102. Similarly, ends 186 and 188 of first back tie member 182 and second back tie member 184 may be sewn to back panel 104. In another embodiment, a heat seal may be used to attach ends 152 and 154 to front panel 102 and ends 186 and 188 to back panel 104. Tie members are of a length that will accommodate most, if not all, wearers of gown 100.

Figure 2:
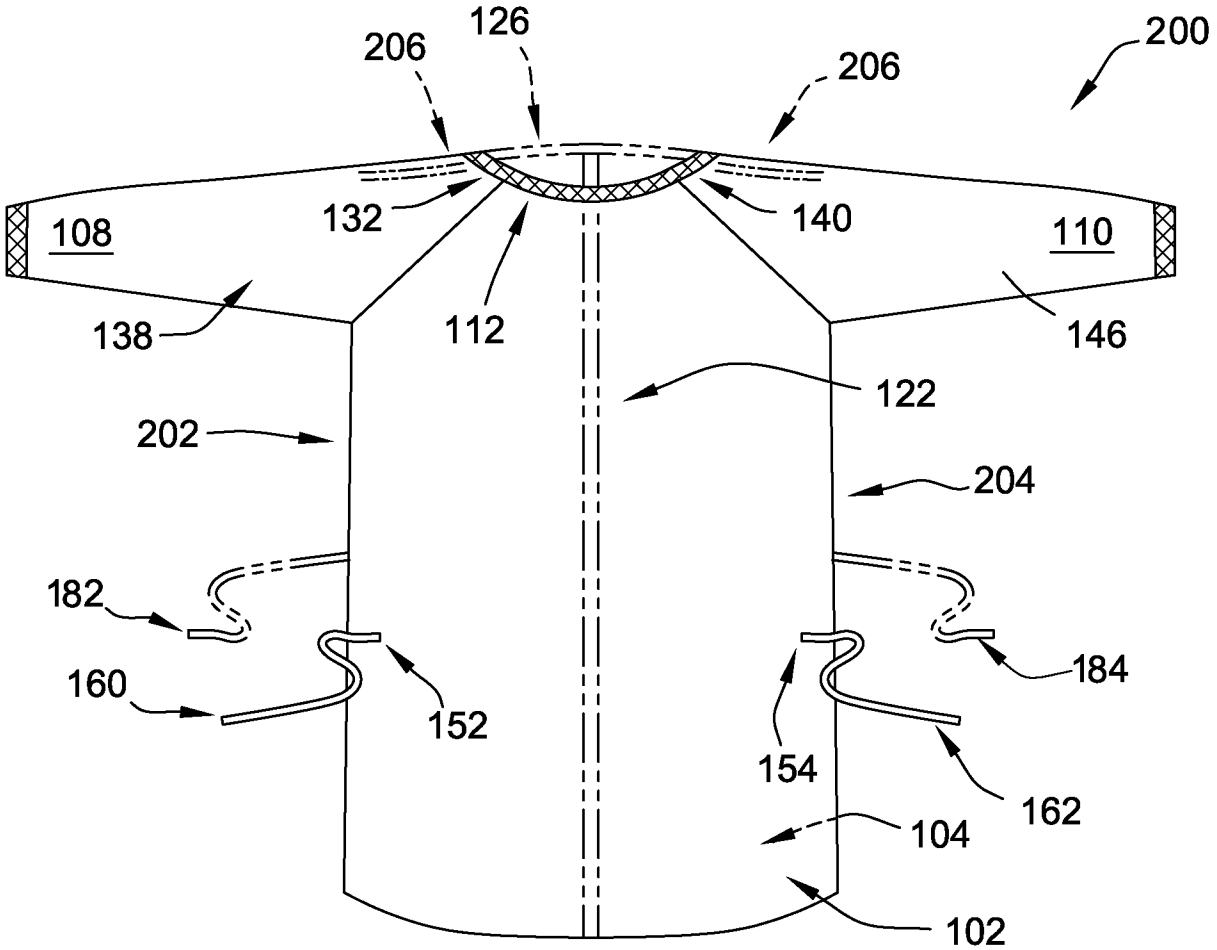
FIG. 2 is a front view of an example embodiment of the isolation contact gown as shown in FIG. 1.

FIG. 2 is a front view of an example embodiment 200 of gown 100 as shown in FIG. 1. In particular, FIG. 2 illustrates the components shown in FIG. 1 connected together to form an example embodiment of gown 100. Components of gown 100 may be attached to each other using one or more of a heat sealing process, stitching, and an adhesive. The attachment process used to attach the components of gown 100 depends at least on the material from which gown 100 is fabricated. When properly worn, the shoulders, arms, torso and a portion of the wearer's legs are covered by gown 100. In the example embodiment, back panel 104 is coupled to front panel 102 at a pair of side seams, such as at a first side seam 202 and at a second side seam 204. Front panel 102 and back panel 104 are substantially equal in length. Similarly, first arm panel 108 and second arm panel 110 are substantially equal in length to fully cover the wearer's arms. Gown 100 includes fully formed sleeves (first sleeve 138 and second sleeve 146) through which the wearer inserts his/her respective arms.

First arm panel back edge 136 is coupled to first back shoulder edge 128 (both shown in FIG. 1). Similarly, second arm panel back edge 144 is coupled to second back shoulder edge 130 (both shown in FIG. 1). In the example embodiment, first arm panel back edge 136 is coupled to first back shoulder edge 128 at a shoulder line of weakness 206. Similarly, second arm panel back edge 144 is coupled to second back shoulder edge 130 at a shoulder line of weakness 206. First front shoulder edge 114 is coupled to first arm panel front edge 134 (both shown in FIG. 1). Similarly, second front shoulder edge 116 is coupled to second arm panel front edge 142 (both shown in FIG. 1). In the example embodiment, front collar edge 112, first arm panel collar edge 132, second arm panel collar edge 140, and back collar edge 126 are arranged to define a head opening. The gown is meant to be worn over the wearer's head through the head opening. The head opening is generally a shallow U-shape when viewed from the front or back of gown 100. When properly worn, the shoulders, arms, torso and a portion of the wearer's legs are protected by gown 100.

Front collar edge 112 is non-removably attached to first arm panel collar edge 132 and second arm panel collar edge 140. In one embodiment, front collar edge 112, first arm panel collar edge 132, and second arm panel collar edge 140 are unitarily formed. In the example embodiment, front collar edge 112, first arm panel collar edge 132, and second arm panel collar edge 140 include elastic gatherings (e.g., elastic bands, elastic straps) to provide a secure fit around the wearer's neck. Back collar edge 126 is detachably coupled to first arm panel collar edge 132 and second arm panel collar edge 140. As explained in FIG. 1, back line of weakness 122 extends from back collar edge 126 to back bottom edge 124. In the exemplary embodiment, back line of weakness 122 and the line of weakness spanning back collar edge 126 form a weak point in the material from which gown 100 is fabricated. Thus, pulling a portion of front panel 102 away from the wearer's body will cause a breakage proximate the head opening, and allow for a relatively easy separation of first back panel portion 118 and second back panel portion 120 (both shown in FIG. 1) by the wearer.

As explained in FIG. 1, first front tie member 160 and second front tie member 162 may be affixed to front panel 102, and first back tie member 182 and second back tie member 184 may be affixed to back panel 104. In the example embodiment, first front tie member 160 and first back tie member 182 may be brought together near first side seam 202 and tied together at one side of the wearer's body. Similarly, second front tie member 162 and second back tie member 184 may be brought together near second side seam 204 and tied together at the other side of the wearer's body.

Although the terms first and second may be used herein to describe various elements, components, and/or sections, these elements, components, and/or sections should not be limited by these terms. These terms may be used only to distinguish one element, component, or section from another element, component, or section. Terms such as "first" and "second" when used herein do not imply a sequence or order unless clearly indicated by the context. Thus, a first element, component, or section discussed below could be termed a second element, component, or section without departing from the teachings of the example embodiments.

Figure 3:
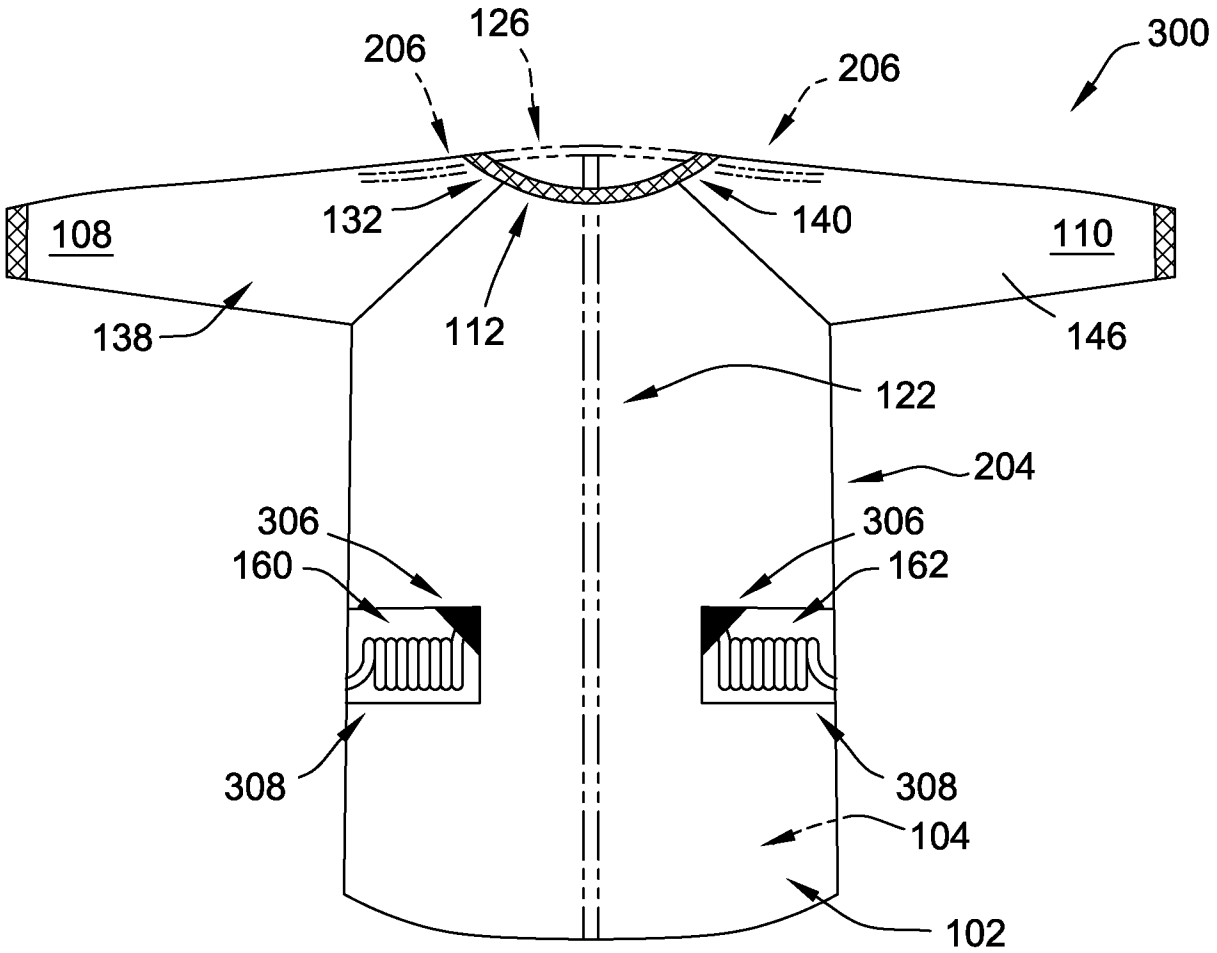
FIG. 3 is a front view of another example embodiment of the isolation contact gown.

FIG. 3 is a front view of another example embodiment 300 of gown 100. In particular, FIG. 3 illustrates a closed configuration of first front tie member 160 and second front tie member 162 shown in FIGS. 1 and 2. Tie members 160 and 162 (e.g., first front tie member 160 and second front tie member 162) may be attached to front panel 102 using the previously-described fastening mechanisms. In some embodiments, tie members 160 and 162 are spring-loaded and/or coil-shaped. For example, in these embodiments, first back tie member 182 and second back tie member 184 (shown in FIGS. 1 and 2) may be spring-loaded and/or coil-shaped. Tie members 160 and 162 may be of elastic material. In certain embodiments, tie members 160 and 162 are of flexible material such that when pulled by the wearer, tie members 160 and 162 extend into an open configuration, and when released by the wearer, retract to their original shape (e.g., closed configuration).

In the example embodiment, tie members 160 and 162 retain a relatively compressed shape in the closed configuration as they are enclosed in a protective covering 308. In the open configuration, tie members 160 and 162 are released from protective covering 308, and are similar to or the same as the disposition of tie members 160 and 162 as shown in FIG. 2. In some embodiments, a portion or the entirety of tie members 160 and 162 may be spring-loaded and/or coil-shaped, such that in the open configuration, tie members 160 and 162 stretch in an accordion-like manner.

In the example embodiment, the protective covering 308 (e.g., protective film) may be a plastic film (e.g., peel-off film), adhesive, and/or any suitable material that can fully cover tie members 160 and 162. Protective covering 308 prevents unused tie members from potentially interfering with the wearer's activities and inconveniencing the wearer by allowing the unused tie members to be tucked away. Protective covering 308 includes a pull tab 306 that enables the wearer to remove protective covering 308 to access an enclosed tie member. The wearer may subsequently extend the enclosed tie member from a closed (e.g., compressed) configuration to an open configuration. In the example embodiment, the wearer extends tie members 160 and 162 into an open configuration to tie each together with first back tie member 182 and second back tie member 184 (both shown in FIGS. 1 and 2).

In further embodiments, first back tie member 182 and second back tie member 184 may also have a closed configuration and an open configuration similar to tie members 160 and 162 as described above. Protective covering 308 and pull tab 306 are also provided for first back tie member 182 and second back tie member 184. In further embodiments, protective covering 308 and pull tab 306 may be provided for some or all of first front tie member 160, second front tie member 162, first back tie member 182 and second back tie member 184.

Figure 4:
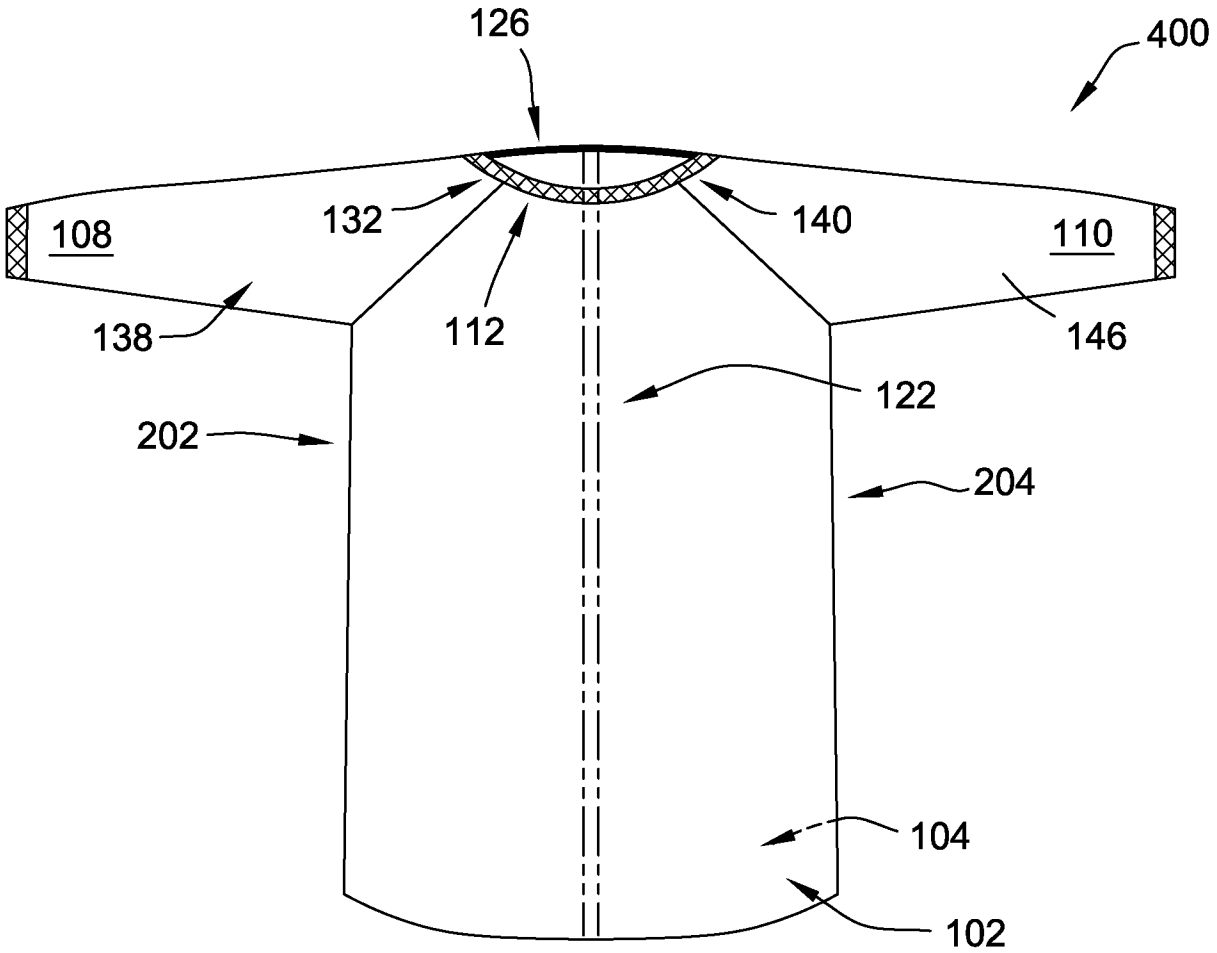
FIG. 4 is a front view of another example embodiment of the isolation contact gown.

FIG. 4 is a front view of another example embodiment 400 of gown 100. In particular, FIG. 4 illustrates an embodiment of gown 100 without any shoulder line of weakness 206 and without any tie members 160 and 162 (as shown in FIGS. 1-3). As shown in FIG. 4, gown 100 has back line of weakness 122 extending from proximate back collar edge 126 to back bottom edge 124 (shown in FIG. 1). Back line of weakness 122 forms a weak point in back panel 104 (shown in FIG. 1). First arm panel back edge 136 is fixedly coupled to first back shoulder edge 128 (both shown in FIG. 1). Similarly, second arm panel back edge 144 is fixedly coupled to second back shoulder edge 130 (both shown in FIG. 1). Thus, a wearer can remove gown 100 by pulling a portion of front panel 102 away from the wearer's body. This pulling motion will cause gown 100 to tear along back line of weakness 122, thereby separating back panel 104 into first back panel portion 118 and second back panel portion 120 for easy removal (both shown in FIG. 1). In some embodiments, back line of weakness 122 extends through back collar edge 126 to allow back panel 104 and back collar edge 126 to fully separate when the wearer pulls on front panel 102, thereby enabling gown 100 to be removed with ease. In the example embodiment, front collar edge 112, first arm panel collar edge 132, and second arm panel collar edge 140 include elastic gatherings (e.g., elastic bands, elastic straps), as described above, to provide a secure fit around the wearer's neck. In further embodiments, elastic gatherings may be provided on the front panel and/or the back panel (not shown) to allow the gown to securely fit the wearer without a tie member. In these embodiments, elastic may be provided as part of the gown material, and may enable the front panel and/or the back panel to stretch and contract based upon the size of the wearer to ensure a snug fit for the wearer.

Figure 5:
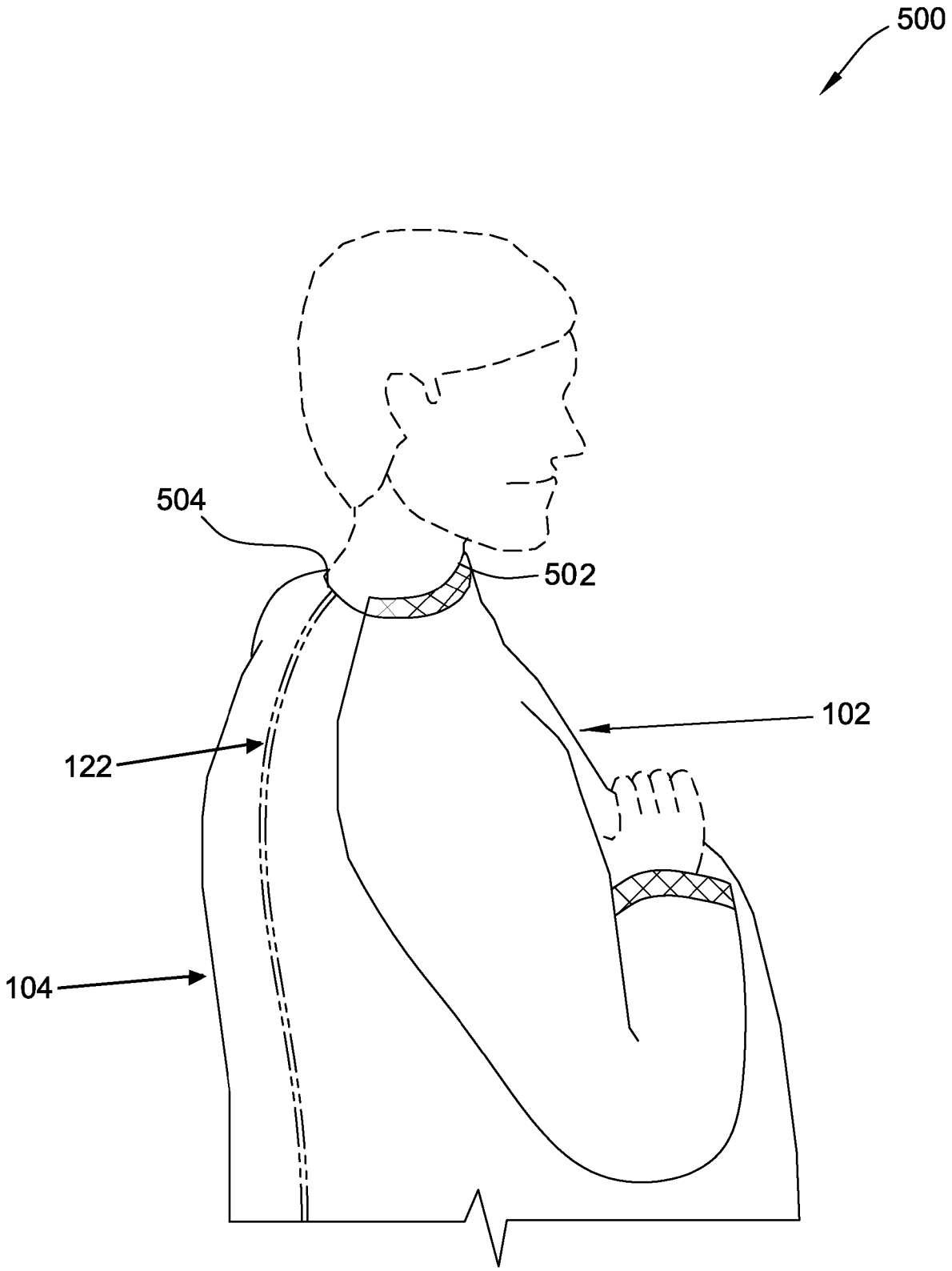
FIG. 5 is a side view of a wearer wearing an example embodiment of the isolation contact gown.

FIG. 5 is a side view of a wearer wearing an example embodiment 500 of gown 100. In particular, FIG. 5 illustrates the collar of gown 100. The collar consists of a front collar portion 502 and a back collar portion 504. As shown in FIG. 5, front collar portion 502 is higher than back collar portion 504 of gown 100. Front collar portion 502 extends at least half the circumference of the collar. In the example embodiment, front collar portion 502 is formed by front collar edge 112, first arm panel collar edge 132, and second arm panel collar edge 140 (shown in FIG. 1). Back collar portion 504 is formed by back collar edge 126 (shown in FIG. 1). In the example embodiment, front collar edge 112, first arm panel collar edge 132, and second arm panel collar edge 140 all have a height that is greater than a height of back collar edge 126.

In the example embodiment, back collar portion 504 is similar to a crew neck collar style while front collar portion 502 is similar to a mock turtleneck collar style. More specifically, back collar portion 504 is positioned at the base of the wearer's neck (e.g., at the neckline) while front collar portion 502 extends above the wearer's neckline and covers a portion of the wearer's neck. The front collar portion 502 may include elastic material to provide a secure fit around a portion of the wearer's neck. By extending above the wearer's neckline, front collar portion 502 enables portions of the wearer's clothing extending above the wearer's neckline, such as a dress shirt collar, to be more fully covered and protected from sources of infectious agents (e.g., blood, bodily fluids, secretions) when the wearer interacts with patients.

Similar to embodiment 400 (shown in FIG. 4), embodiment 500 of gown 100 also has back line of weakness 122 extending from proximate back collar portion 504 to back bottom edge 124 (shown in FIG. 1) without any shoulder line of weakness 206 and without any tie members 160 and 162 (as shown in FIGS. 1-3). In the example embodiment, back line of weakness 122 extends through back collar edge 126 of back collar portion 504. A wearer removes gown 100 by pulling a portion of front panel 102 away from the wearer's body, as shown in FIG. 5. This pulling motion enables gown 100 to tear along back line of weakness 122, thereby separating back panel 104 into first back panel portion 118 and second back panel portion 120 for easy removal (both shown in FIG. 1).

Although specific features of various embodiments of the disclosure may be shown in some drawings and not in others, this is for convenience only. In accordance with the principles of the disclosure, any feature of a drawing may be referenced and/or claimed in combination with any feature of any other drawing.

The above described embodiments improve on the prior art by addressing the shortcomings associated with gown removal and resistance to material tearing during use. As such, this written description uses examples to illustrate the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A disposable contact isolation gown comprising:

a front panel comprising a front collar edge, a pair of front shoulder edges, a pair of front side edges, and a front bottom edge;

a back panel coupled to the front panel at a pair of side seams, wherein the back panel comprises a back collar edge, a pair of back shoulder edges extending from the back collar edge, a back bottom edge, a back perforated line of weakness extending from the back collar edge to the back bottom edge, and a pair of back panel portions coupled together at the back perforated line of weakness;

a pair of arm panels coupled between the front panel and the back panel, wherein each arm panel comprises an arm panel back edge, an arm panel front edge, and an arm panel collar edge, the arm panel back edge of each arm panel being detachably coupled to one of the back shoulder edges at a shoulder perforated line of weakness, wherein the back perforated line of weakness is positioned on the back panel between the shoulder perforated lines of weakness, the arm panel collar edges each extending in an arc between the front collar edge and the back collar edge, wherein the front collar edge, the back collar edge, and the arm panel collar edges collectively define a closed head opening for receiving a head of a user therein during a pull-over donning of the gown, and wherein the back collar edge further comprises a collar perforated line of weakness extending along the back collar edge and connecting the shoulder perforated lines of weakness; and a pair of first tie members attached to the front panel and a pair of second tie members attached to the back panel, the first and second tie members being sized to be tied to each other at respective sides of the gown to tightly secure the gown on a body of the user.

2. The disposable contact isolation gown in accordance with claim 1, wherein the back perforated line of weakness comprises a plurality of perforated lines of weakness oriented parallel relative to each other.

3. The disposable contact isolation gown in accordance with claim 1, wherein the back perforated line of weakness is configured to tear and split the back panel into the back panel portions when the front panel is pulled away from a user wearing the disposable contact isolation gown.

4. The disposable contact isolation gown in accordance with claim 1, wherein the back perforated line of weakness is configured to be substantially equal to a length of the pair of back panel portions.

5. The disposable contact isolation gown in accordance with claim 1, further comprising a collar comprising a front collar portion and a back collar portion, wherein the front collar portion includes the front collar edge and the arm panel collar edges, wherein the back collar edge includes the back collar edge, and wherein the front collar portion has a height that is greater than a height of the back collar portion.

6. The disposable contact isolation gown in accordance with claim 1, wherein each tie member is positioned at opposing side edges of the at least one of the front panel and the back panel, and wherein each tie member is enclosed in a protective film having a pull tab.

7. The disposable contact isolation gown in accordance with claim 1, wherein the front collar edge and the arm panel collar edges are unitarily formed of an elastic gathering, the back collar edge being detachably coupled to the elastic gathering at the arm panel collar edges.

8. The disposable contact isolation gown in accordance with claim 1, wherein the back collar edge is detachably coupled to the arm panel collar edges.

9. The disposable contact isolation gown in accordance with claim 1, wherein each arm panel further comprises a cuff edge that is distal to the arm panel collar edge, and wherein the cuff edge and the arm panel collar edge comprise an elastic gathering.

10. A disposable contact isolation gown comprising:

a front panel comprising a front collar edge, a pair of front shoulder edges, a pair of front side edges, and a front bottom edge;

a back panel coupled to the front panel at a pair of side seams, wherein the back panel comprises a back collar edge, a pair of back shoulder edges extending from the back collar edge, a pair of back side edges, a back bottom edge, and a back perforated line of weakness extending from the back collar edge to the back bottom edge;

a pair of arm panels coupled between the front panel and the back panel, wherein each arm panel comprises an arm panel back edge, an arm panel front edge, an arm panel collar edge, a sleeve back edge, a sleeve front edge, and a cuff edge, the arm panel back edge of each arm panel being detachably coupled to one of the back shoulder edges at a shoulder perforated line of weakness, each of the shoulder perforated lines of weakness extending to the back collar edge with the back perforated line of weakness being positioned on the back panel between the shoulder perforated lines of weakness, the arm panel collar edges each extending in an arc between the front collar edge and the back collar edge, the front collar edge, the back collar edge, and the arm panel collar edges collectively defining a closed head opening for receiving a head of a user therein during a pull-over donning of the gown, and wherein the back collar edge further comprises a collar perforated line of weakness extending along the back collar edge and connecting the shoulder perforated lines of weakness; and a pair of first tie members attached to the front panel and a pair of second tie members attached to the back panel, the first and second tie members being sized to be tied to each other at respective sides of the gown to tightly secure the gown on a body of the user.

11. The disposable contact isolation gown in accordance with claim 10, wherein the back panel further comprises a pair of back panel portions coupled together at the back perforated line of weakness.

12. The disposable contact isolation gown in accordance with claim 10, wherein each tie member is positioned at opposing side edges of the at least one of the front panel and the back panel, and wherein each tie member is enclosed in a protective film, the protective film including a pull tab.

13. The disposable contact isolation gown in accordance with claim 10, wherein the cuff edge of each arm panel is distal to the arm panel collar edge, and wherein the cuff edge and the arm panel collar edge comprise an elastic gathering.

14. The disposable contact isolation gown in accordance with claim 10, wherein the back collar edge is detachably coupled to the arm panel collar edges.

15. A method of manufacturing a disposable contact isolation gown comprising:

providing a front panel comprising a front collar edge, a pair of front shoulder edges, a pair of front side edges, and a front bottom edge;

providing a back panel, wherein the back panel comprises a back collar edge, a back bottom edge, a pair of back shoulder edges extending from the back collar edge, a back perforated line of weakness extending from the back collar edge to the back bottom edge, and a pair of back panel portions coupled together at the back perforated line of weakness;

providing a pair of arm panels, wherein each arm panel comprises an arm panel back edge, an arm panel front edge, and an arm panel collar edge;

coupling the front panel to the back panel at a pair of side seams;

coupling a pair of first tie members to the front panel and a pair of second tie members to the back panel, the first and second tie members being sized to be tied to each other at respective sides of the gown to tightly secure the gown on a body of a user; and coupling each of the pair of arm panels between the front panel and the back panel, the arm panel back edge of each arm panel being detachably coupled to one of the back shoulder edges at a shoulder perforated line of weakness, wherein the back perforated line of weakness is positioned on the back panel between the shoulder perforated lines of weakness, the arm panel collar edges each extending in an arc between the front collar edge and the back collar edge, wherein the front collar edge, the back collar edge, and the arm panel collar edges collectively defining a closed head opening for receiving a head of the user therein during a pull-over donning of the gown, and wherein the back collar edge further includes a collar perforated line of weakness extending along the back collar edge and connecting the shoulder perforated lines of weakness.

16. The method of claim 15, wherein the back perforated line of weakness is configured to tear and split the back panel into the back panel portions when the front panel is pulled away from a user wearing the disposable contact isolation gown.

17. The method of claim 15, further comprising covering each tie member with a protective film, the protective film having a pull tab.

* * * * *